US006036016A

United States Patent [19]

Arnold

[11] Patent Number: 6,036,016

[45] Date of Patent: Mar. 14, 2000

[54] BLISTER PACKAGE WITH EASY TEAR BLISTER

[75] Inventor: William Arnold, Doylestown, Pa.

[73] Assignee: Pinnacle Intellectual Property Services, Inc., Paradise Valley, Nev.

[21] Appl. No.: 09/063,165

[22] Filed: Apr. 20, 1998

[51] Int. Cl.[7] ..... B65D 83/04

[52] U.S. Cl. ..... 206/532; 206/531; 206/469

[58] Field of Search ..... 206/467, 469, 206/531, 532, 534

[56] References Cited

U.S. PATENT DOCUMENTS

| | | | |
|---|---|---|---|
| Re. 29,705 | 7/1978 | Compere . | |
| 3,456,784 | 7/1969 | Sirago . | |
| 3,503,493 | 3/1970 | Nagy | 206/534 |
| 3,872,970 | 3/1975 | Edison | 206/532 |
| 3,921,805 | 11/1975 | Compere | 206/532 |
| 3,941,248 | 3/1976 | Moser et al. | 206/531 |
| 4,159,771 | 7/1979 | Komatsu et al. | 206/532 |
| 4,211,329 | 7/1980 | Braverman | 206/534 |
| 4,231,477 | 11/1980 | De Felice . | |
| 4,243,144 | 1/1981 | Margulies . | |
| 4,280,621 | 7/1981 | Tonrey | 206/534 |
| 4,398,634 | 8/1983 | McClosky | 206/532 |
| 4,493,574 | 1/1985 | Redmond et al. . | |
| 4,506,789 | 3/1985 | Dlugosz . | |
| 4,574,951 | 3/1986 | Weaver . | |
| 4,574,954 | 3/1986 | Reid . | |
| 4,762,230 | 8/1988 | Croce . | |
| 4,981,213 | 1/1991 | Dillon . | |
| 4,988,004 | 1/1991 | Intini . | |
| 5,033,616 | 7/1991 | Wyser . | |
| 5,046,618 | 9/1991 | Wood . | |
| 5,088,603 | 2/1992 | Kirkpatrick . | |
| 5,123,539 | 6/1992 | De Vries et al. . | |
| 5,147,035 | 9/1992 | Hartman . | |
| 5,358,118 | 10/1994 | Thompson et al. . | |
| 5,360,116 | 11/1994 | Schmiletzky . | |
| 5,378,066 | 1/1995 | Wade . | |
| 5,405,011 | 4/1995 | Haber et al. . | |
| 5,511,665 | 4/1996 | Dressel et al. . | |
| 5,529,188 | 6/1996 | Coggswell . | |
| 5,551,567 | 9/1996 | Malone et al. | 206/469 |

*Primary Examiner*—David T. Fidei
*Attorney, Agent, or Firm*—Michael D. Steffensmeier; Donald O. Nickey

[57] ABSTRACT

A blister package is disclosed that comprises a blister layer having an article receiving blister formed therein for holding medicaments, and a base layer. The blister layer has one or more tearing blisters formed therein and the blister layer is joined to the base layer except in the areas of the article receiving blister and the tearing blisters. The base layer and the blister layer are joined such that opening the blister package to access the medicament requires tearing through one of the tearing blisters and the article receiving blister. The tearing blisters preferably extend from one or more outer edges, which may include the corners, of the blister layer toward said article receiving blister. The portions of the base layer and the blister layer that are joined together cannot be readily torn from the outer edges of the blister package, but the portion of the blister layer that forms the tearing blister is thin enough that the tearing blister and the portion of the base layer under the tearing blister can be readily torn from the outer edge of the blister package.

19 Claims, 6 Drawing Sheets

BLISTER PACKAGE WITH EASY TEAR BLISTER

FIELD OF THE INVENTION

The present invention generally relates to medication packages and, more particularly, relates to child resistant blister packages.

BACKGROUND AND SUMMARY OF THE INVENTION

There is a continued need for medication packages that are child resistant and tamper evident, yet allow the average adult to open the medication packages to get access to the medication therein. There is also a need to make this type of package economical to manufacture.

In the past, there have been a number of different medication packages developed. Many of the packages have a top layer with blisters to hold the medication and a bottom layer sealed to the top layer to enclose the medication in the blister. In some instances, the bottom layer is made of foil that can be ruptured when the medication in the blister is pushed against the bottom layer. This is tamper evident but typically not child resistant. Other medication packages require some form of peeling the bottom surface from the top surface to get access to the medication. Some examples of these types of medication packages that use peeling include U.S. Pat. Nos. Re 29,705 (Compere), 3,941,248 (Moser), 4,243,144 (Margulies), 4,988,004 (Intini), 5,046,618 (Wood), and 5,358,118 (Thompson). Child resistant medication packages that use peeling have been in use for some time, however, some people who do not have sufficient motor skills or whose hands shake are not able to easily gain access to the medicament is such packages. This can be a problem especially when the medicament and the medication packages are small.

There have been a number of medication packages that are designed to be torn open to access the medication. One patent that discloses a tear-open package does not relate to medication packages, but instead relates to a rigid, fluid-tight, hand fracturable container for protecting O-rings and other small rubber or synthetic plastic parts from deterioration and deformation, is U.S. Pat. No. 3,456,784 (Sirago). The figures showing a plan view in this Pat. No. 3,456,784 look similar to what a plan view of the present invention may look like. However, a closer analysis of the text and figures of U.S. Pat. No. 3,456,784 shows that the invention disclosed in U.S. Pat. No. 3,456,784 actually teaches away from the present invention disclosed below. U.S. Pat. No. 3,456,784 discloses weakened fracture lines that are formed by "fusing" the first panel to the second panel (see col. 1, lines 66–68, col. 3, lines 27–29, and col. 4, lines 22–25). Unlike U.S. Pat. No. 3,456,784, the present invention has tearing blisters formed in the blister layer and the blister layer is not joined to the base layer in the areas of the tearing blisters. Therefore, instead of fusing the first panel and second panel together to form a weakened fracture line, the present invention does the opposite by not fusing the blister layer and the base layer together at the tearing blisters. In fact, in accordance with the present invention, the blister layer and the base layer are not even sealed together at the tearing blisters.

U.S. Pat. No. 5,088,603 (Kirkpatrick) discloses a tear-open medication package that has a tear slit disposed through the package directed at one end of the blister containing the medicament. The tear slit is a cut or perforation through the entire package (i.e., the blister layer and the base layer). The use of a tear slit attempts to make the medication package easier to tear open the package, but in practice these packages (e.g., used for Tylenol Cold®) can still be difficult to open by an adult. There is a need for a medication package that can be relatively easy to tear for an adult, but still be child resistant.

The present invention provides a novel blister package for use with small or large medicaments of various shapes. The present invention discloses a blister package that implements tearing to be opened, thereby avoiding some of the inherent problems of medication packages that use peeling to be opened. The blister package of the present invention can be relatively easy to tear for an adult, but not easy for a child to access a medicament within the package. The present invention is economical to make because it uses tear blisters that are formed in the same manner as the article receiving blisters therein.

The blister package of the present invention comprises a blister layer having an article receiving blister formed therein for holding medicaments, and a base layer. The blister layer has one or more tearing blisters formed therein and the blister layer is joined to the base layer except in the areas of the article receiving blister and the tearing blisters. The base layer and the blister layer are joined such that opening the blister package to access the medicament requires tearing through one of the tearing blisters and the article receiving blister. The tearing blisters preferably extend from one or more outer edges, which may include the corners, of the blister layer toward said article receiving blister. The portions of the base layer and the blister layer that are joined together cannot be readily torn from the outer edges of the blister package, but the portion of the blister layer that forms the tearing blister is thin enough that the tearing blister and the portion of the base layer under the tearing blister can be readily torn from the outer edge of the blister package.

Another embodiment of the present invention is a medication package comprising a plurality of separable blister packages like those described in the preceding paragraph. These separable blister packages have their base layer and/or blister layer formed from one integral base layer and one integral blister layer with tear lines in the base layer and/or the blister layer to enable the separation of the individual blister packages from each other. These tear lines may be perforations, score lines, slits, weakened fracture lines, and/or even tearing blisters. Another embodiment of the medication package of the present invention includes a separable header portion connected to one or more of the blister packages. The header portion preferably has an area on which drug information, bar codes, etc. can be printed.

Various objects and advantages of the present invention will become apparent from the following detailed description when viewed in conjunction with the accompanying drawings, which set forth certain embodiments of the invention.

DETAILED DESCRIPTION OF THE PREFERRED EMBODIMENTS

Figure 1:
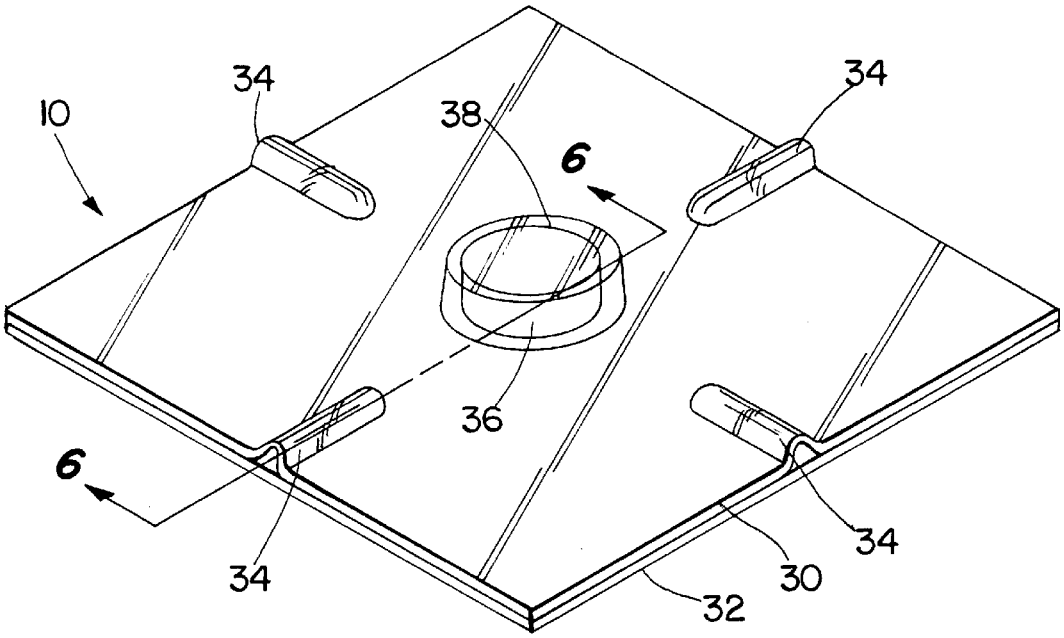
FIG. 1 is a perspective view of an embodiment of the blister package in accordance with the present invention.

The detailed embodiments of the present invention are disclosed herein. It should be understood, however, that the enclosed embodiments are merely exemplary of the invention, which may be embodied in various forms. Therefore, the details disclosed herein are not to be interpreted as limiting, but merely as a basis for teaching one skilled in the art how to make and/or use the invention.

Referring now to the drawings, preferred embodiments of the blister package of the present invention are shown in FIGS. 1–9. The present invention is a blister package 10 having a blister layer 30 with an article receiving blister 36 formed therein for holding a medicament 38 and one or more tearing blisters 34 formed therein. There may be more than one article receiving blister 36 in the blister package 10. In a preferred embodiment, there are four tearing blisters 34 in the blister package 10, but one or more tearing blisters 34 are acceptable. The blister package 10 also has a base layer 32. The blister layer 30 is joined with the base layer 32 except in the areas of the article receiving blisters 36 and the tearing blisters 34. The blister layer 30 may be joined to the base layer 32 by heat sealing, adhesive such as heat-activated adhesive that has been pre-applied to the base layer 32 or solvent adhesive, RF or sonic seal, or by other suitable means. The base layer 32 and the blister layer 30 are joined such that the opening of the blister package to access the medicament 38 in the article receiving blister 36 requires tearing through one of the tearing blisters 34 and the article receiving blister 36.

Figure 2:
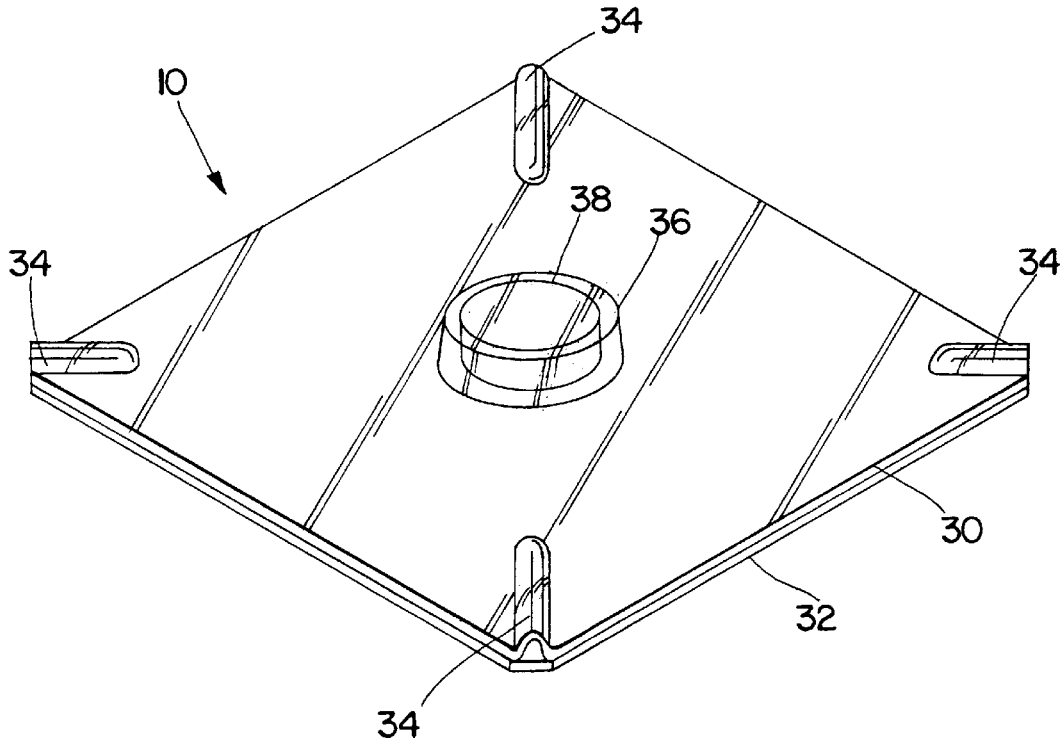
FIG. 2 is a perspective view of another embodiment of the blister package in accordance with the present invention.
Figure 3:
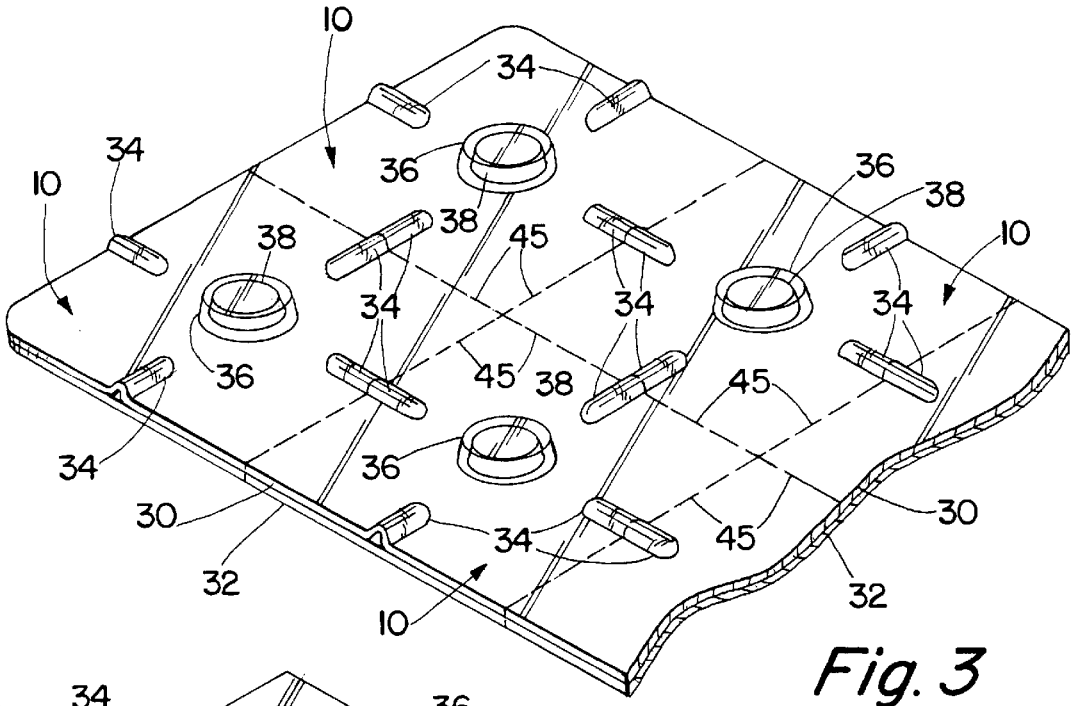
FIG. 3 is a foreshortened isometric view of the medication package having separable blister packages in accordance with the present invention.
Figure 4:
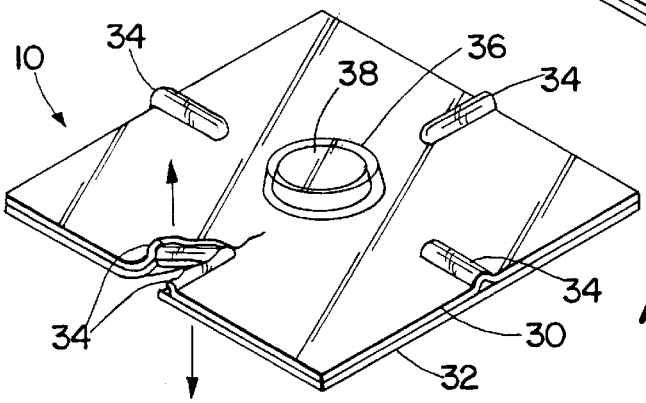
FIG. 4 is an isometric view of the blister package of FIG. 1 showing the initial stages of the tear-opening operation in accordance with the present invention.
Figure 5:
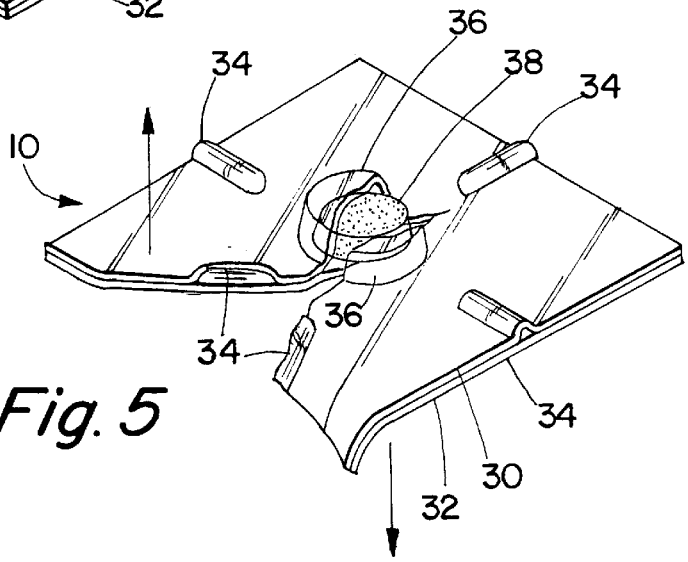
FIG. 5 is an isometric view of the blister package of FIG. 1 showing the final stages of the tear-opening operation in accordance with the present invention.
Figure 6:
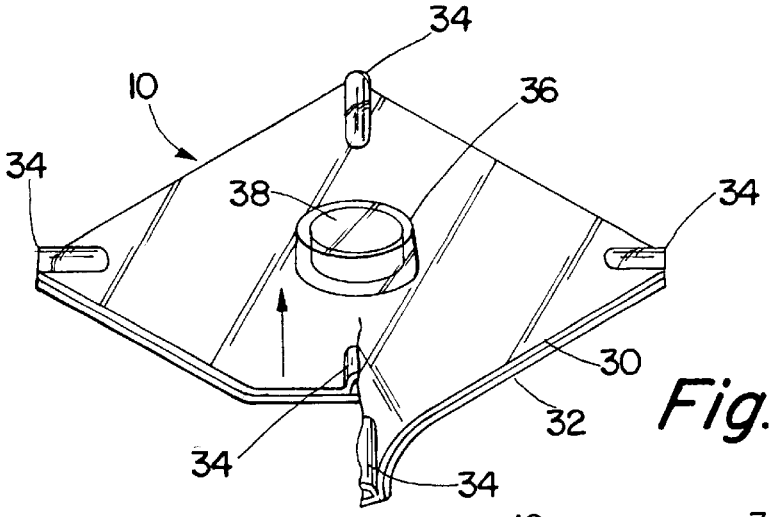
FIG. 6 is an isometric view of the blister package of FIG. 2 showing the initial stages of the tear-opening operation in accordance with the present invention.
Figure 7:
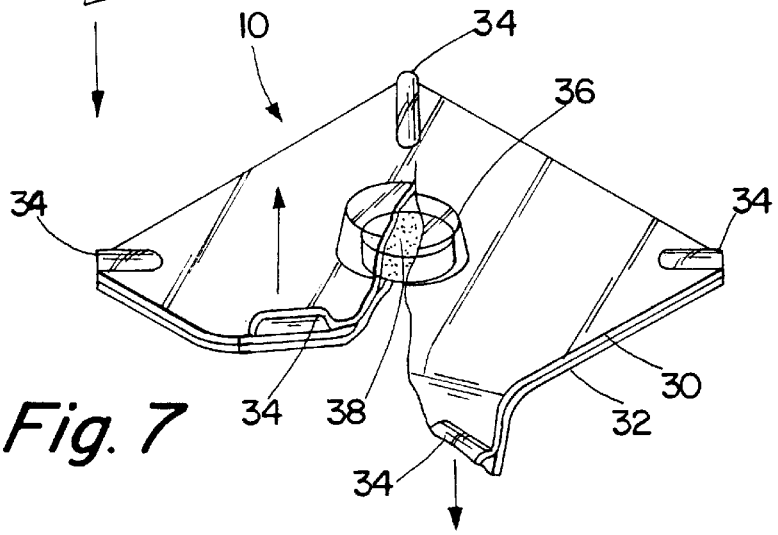
FIG. 7 is an isometric view of the blister package of FIG. 2 showing the final stages of the tear-opening operation in accordance with the present invention.
Figure 8:
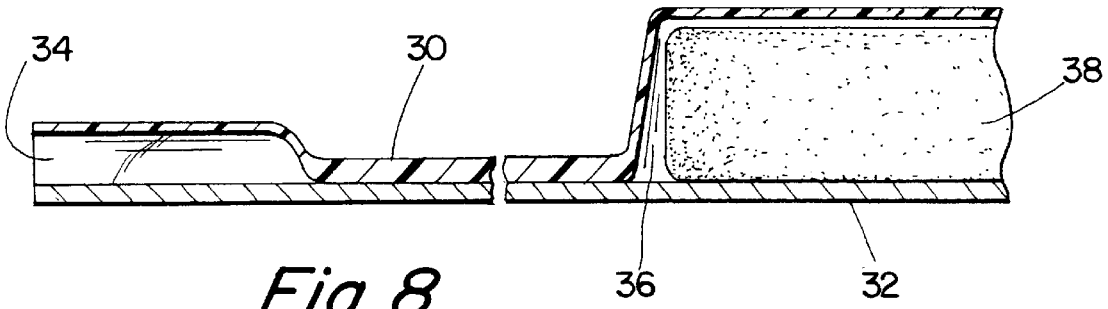
FIG. 8 is a cross section of the embodiment of the blister package shown in FIG. 1, taken as indicated by the lines and arrows 6—6 of FIG. 1.
Figure 9:
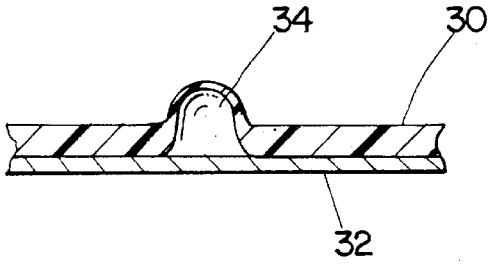
FIG. 9 is a side view of a portion of the blister package with a tearing blister shown in FIG. 1.
Figure 10:
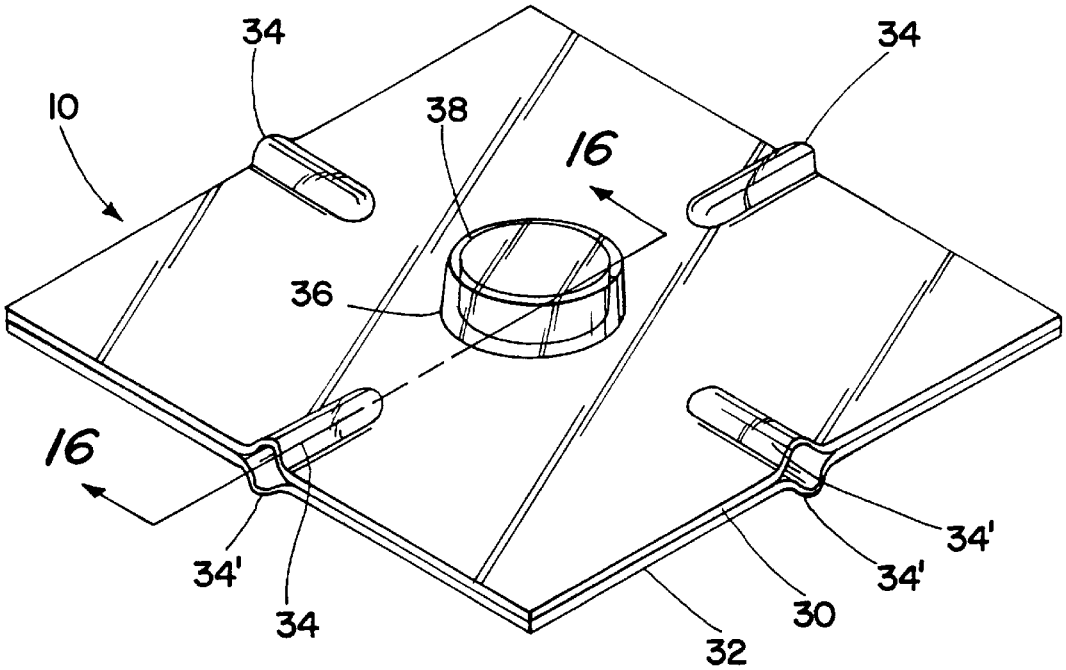
FIG. 10 is an isometric view of the blister package according to the present invention wherein the tearing blister is formed in the base layer and the blister layer.
Figure 11:
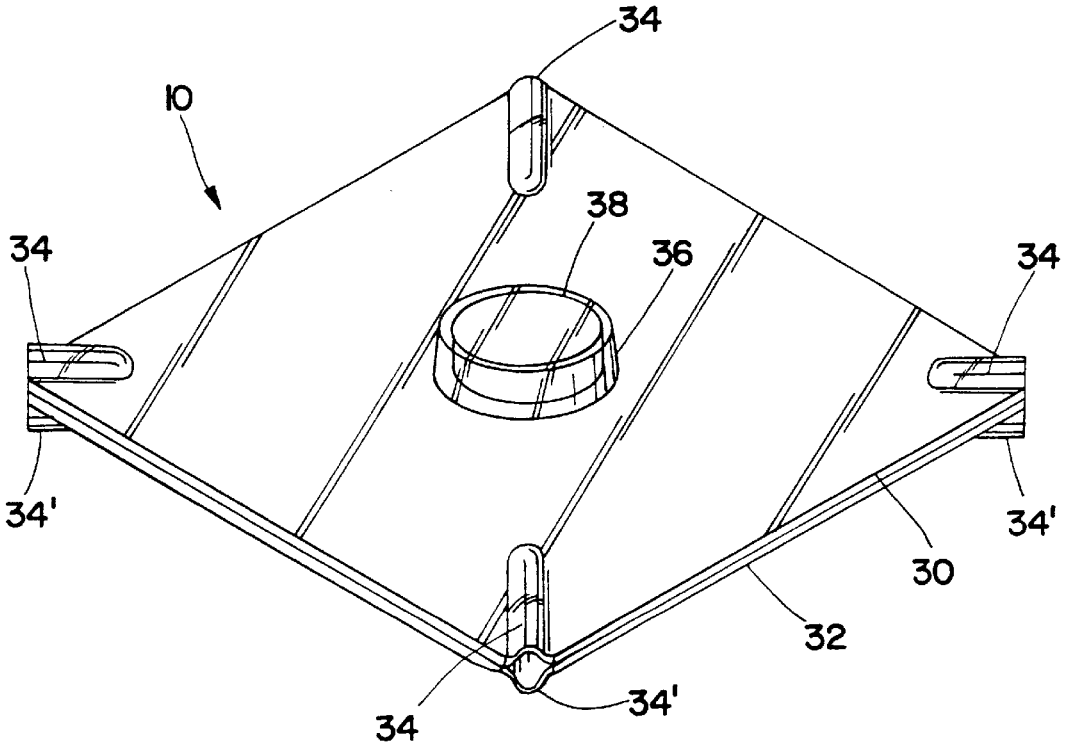
FIG. 11 is an isometic view of the blister package according to the present invention wherein the tearing blisters are at the corners of the package.
Figure 12:
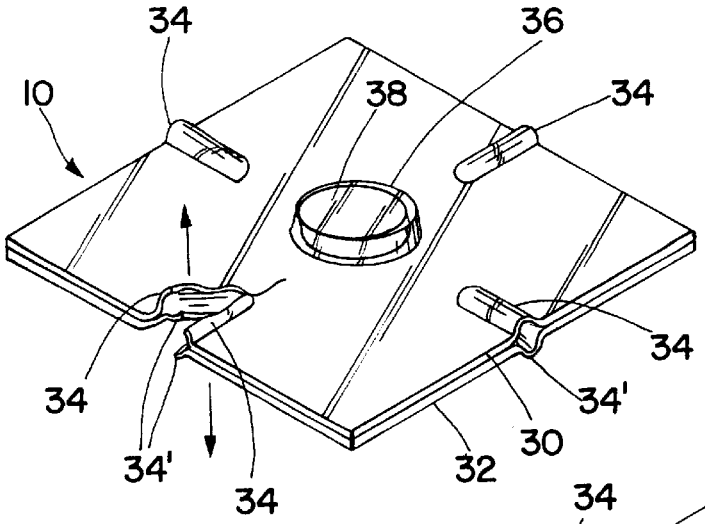
FIG. 12 is an isometric view of the blister package of FIG. 10 showing the initial stages of the tear-opening operation in accordance with the present invention.
Figure 13:
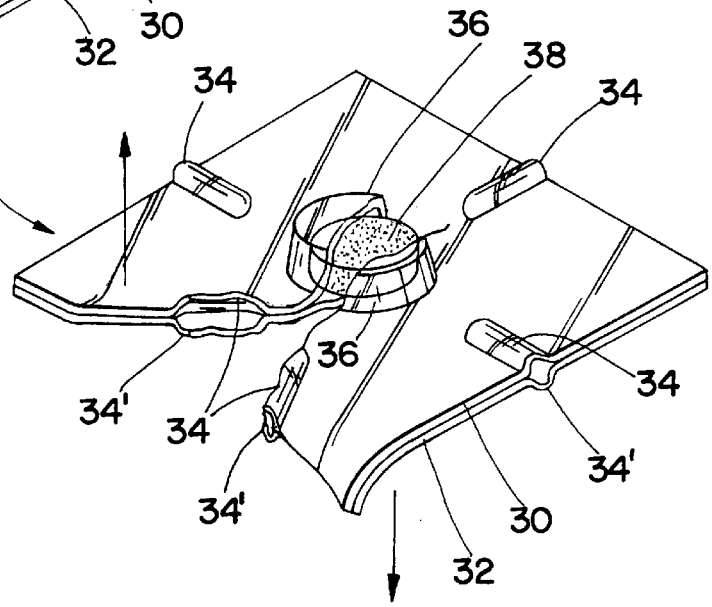
FIG. 13 is an isometric view of the blister package of FIG. 10 showing the final stages of the tear-opening operation in accordance with the present invention.
Figure 14:
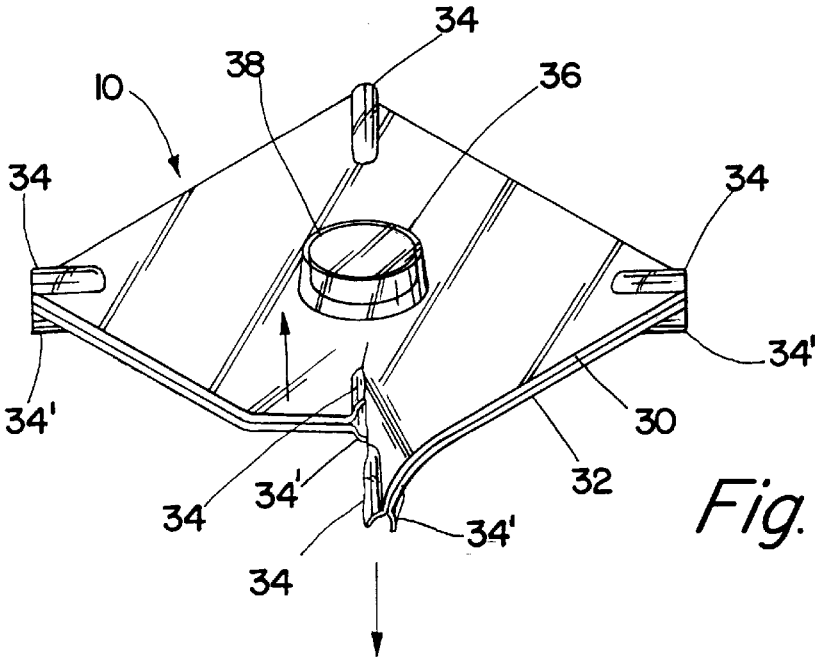
FIG. 14 is an isometric view of the blister package of FIG. 11 showing the initial stages of the tear-opening operation in accordance with the present invention.
Figure 15:
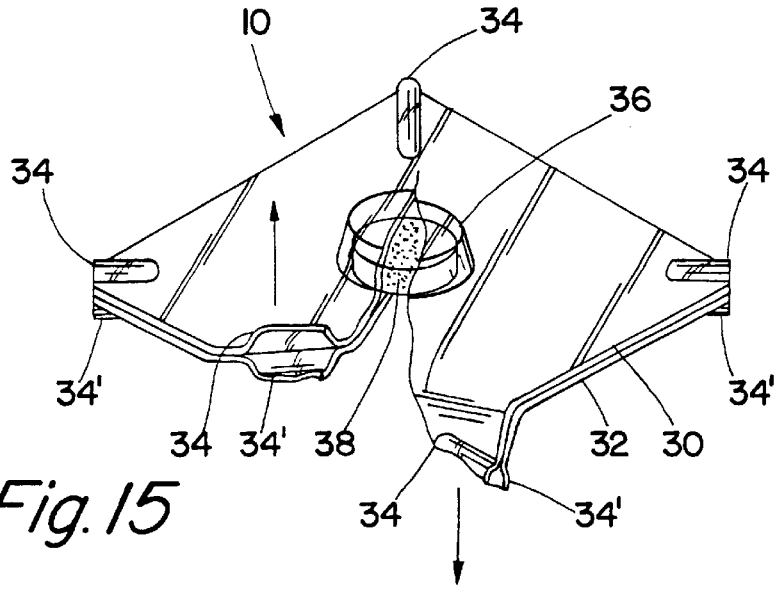
FIG. 15 is an isometric view of the blister Package of FIG. 11 showing the final stages of the tear-opening operation in accordance with the present invention.
Figure 16:
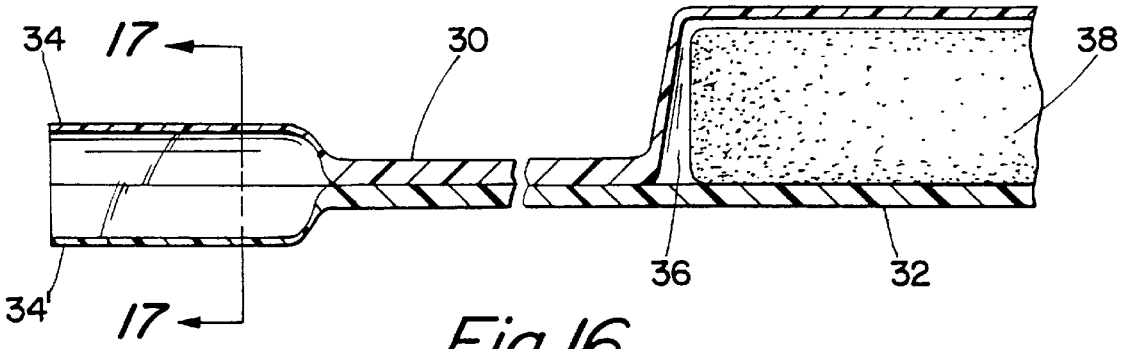
FIG. 16 is a cross- section of the embodiment of the blister package shown in FIG. 10 taken as indicated by the lines and arrows 16—16 of FIG. 10.
Figure 17:
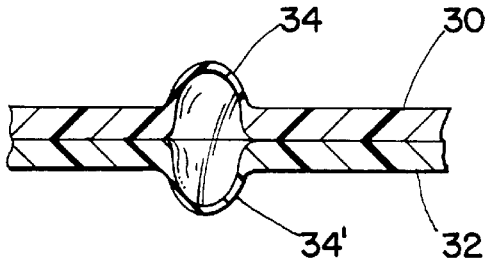
FIG. 17 is a cross-section of the embodiment of the blister package shown in FIG. 16 taken as indicated by the lines and arrows 17–17 of FIG. 16.

In a preferred embodiment, the tearing blisters 34 extend from the outer edges of the blister layer toward said article receiving blister 36, as shown in FIGS. 1–9. The tearing blisters 34 may extend from the sides of the blister package 10 as shown in FIGS. 1, 3, 4, 5 and 9 and/or the corners of the blister package 10 as shown in FIGS. 2, 6 and 7. There may only be one tearing blister 34 extending from the side or comer of the medication package 10 as long as a person can tear through the tearing blister 34 and the article receiving blister 36 to access the medicament 38 therein. In another embodiment, the tearing blister 34 may not extend all of the way to the edge of the medication package 10, but instead may come close enough to the edge such that the portion of the blister layer 30 and the base layer 32 between the edge and the tearing blister 34 is small enough to be readily torn through from the edge to the tearing blister 34. The tearing blisters 34 may be of various shapes as long as the tearing through the tearing blister 34 directs the tear toward the article receiving blister 36. The tearing blisters 34 are preferably elongated in shape, and the tearing blisters 34 may be rectangular, triangular, oblong, etc. The article receiving blister 36 may be of any shape to hold various medicaments 38 therein, including round pills, oval pills, oblong capsules, caplets, etc.

The blister layer 30 is preferably made of pharmaceutical grade PVC or other thermoplastic material, such as plastic, polypropylene, polyethylene, styrene, cold-formed foil, or other suitable materials for packaging. The article receiving blisters 36 and tearing blisters 34 may be formed by a thermoforming process in which the blister layer material is stretched into a cavity with a vacuum technique to form the blister portions. In a preferred embodiment, a sheet of suitable material for the blister layer 30 is exposed to heating elements for a pre-determined time. This sheet is then trapped in a forming station where it is subjected to both vacuum and pressure. During this process, the material may also be mechanically assisted into the blister cavity via a matched metal plug to form the tearing blisters 34 and the article receiving blister 36. In another embodiment, the article receiving blister 36 and the tearing blisters 34 can be formed by using cold-formed foil and cold-form packaging processes. As used herein, "blister package" includes medication packages made with cold-formed foil and using cold-form packaging processes.

These package forming processes thin the blister layer at the tearing blisters 34 and at the article receiving blisters 36. It is a feature of the present invention that the portion of the blister layer 30 that forms the tearing blisters 34 is made thin enough that the tearing blisters 34 and the portion of the base layer 32 under the tearing blisters 34 can be readily torn from the outer edge of the blister package 10. It is also a feature of the present invention that the portions of the base layer 32 and the blister layer 30 that are joined together (the areas other than at the article containing blisters 36 and the tearing blisters 34) cannot be readily torn from the outer edges of the blister package 10.

The preferred starting thickness of the blister layer 30 is 0.010 inches when formed of pharmaceutical grade PVC. The tearing blisters 34 are formed in the blister layer 30, thereby thinning the blister material at the top of the tearing blisters 34 to a preferred thickness of 0.001–0.002 inches, although other thicknesses of the blister layer may be acceptable as long as the tearing blister can be readily torn to access the medicament 38. The tearing blister 34 may be preferably formed with a draw ratio of approximately 2 to 1 to get a thickness of 0.001–0.002 inches at the top of the tearing blister 34. This draw ratio of approximately 2 to 1 means that for every increment in width of the tearing blister 34, the height of the tearing blister 34 is approximately equal to twice the width. This thickness of the layers shown in FIGS. 8 and 9 have been exaggerated for purposes of illustration.

The base layer 32 is comprised of a material and thickness that cannot be ruptured by a person pushing on the medicament 38 in the article receiving blister 36. The base layer 32 may be comprised of one or more separate layers of material, such as foil and polyester or other suitable child-resistant foils. The base layer 32 is typically comprised of multiple layers, but it could be made of any material deemed child-resistant. The base layer 32 also needs to be of a material and/or thickness that can be torn from the edge of the blister package 10 at the tearing blisters 34. Other thicknesses of the tearing blisters 34 and the base layer 32 may be appropriate as long as a person can readily tear through the tearing blister 34 and the base layer 32 to get access to the medicament 38 in the article receiving blister 36, but a person cannot readily tear through the other portions (not at the tearing blisters 34) of the blister layer 30 and the base layer 32. Other appropriate thicknesses may be used for the tearing blisters 34 and the base layer 32 without departing from the scope and spirit of the present invention. In another embodiment, a portion of the base layer 32 under the tearing blisters 34 may be removed to enhance the ease of tearing through the tearing blister 34 to get access to the medicament 38 in the article receiving blister 36. The removal of a portion of the base layer 32 under the tearing blisters 34 preferably occurs before the base layer 32 is joined to the blister layer 30 and this removal can be done by any suitable means including cutting, blanking it out, etc.

FIGS 4–7 illustrate how the medication package 10 of the present invention is torn open. Since the portions of the edges of the medication package 10 that are not at a tearing blister 34 cannot be readily torn, the only way that access to the medicament 38 in the article receiving blister 36 can be readily obtained is by grasping the portions of the medication package 10 on each side of a tearing blister 34 and pulling these portions in opposite directions. This causes a tear through the tearing blisters 34 that propagates through the medication package 10 and through the article receiving blister 36, thereby providing access to the medicament 38.

In other embodiments, tearing blisters 34 may be formed in the base layer 32 rather than in the blister layer 30 or in addition to tearing blisters 34 in the blister layer 32. Also, cavities may be formed in the blister layer 30 and the base layer 32 that result in tearing blisters 34 when the blister layer 30 and the base layer 32 are sealed together. Similarly, cavities may be formed in the blister layer 30 and the base layer 32 that result in article receiving blisters 36 when the blister layer 30 and the base layer 32 are sealed together.

Another preferred embodiment of the present invention is a medication package 20 comprising a plurality of separable blister packages 10 like those described above (see FIG. 3). These separable blister packages 10 have their base layer 32 and/or blister layer 30 formed from one integral base layer 32 and one integral blister layer 30 with tear lines 45 on the base layer 32 and the blister layer 30 to enable the separation of the individual blister packages 10 from each other. These tear lines 45 may be perforations, score lines, slits, weakened fracture lines, and/or even tearing blisters. Another embodiment of the medication package 20 of the present invention includes a separable header portion connected to one or more of the blister packages. The header portion preferably has an area on which drug information, bar codes, etc. can be printed.

Having described the invention in detail, those skilled in the art will appreciate that, given the present disclosure, modifications may be made to the invention without departing from the spirit of the inventive concept herein described. Therefore, it is not intended that the scope of the invention be limited to the specific and preferred embodiments illustrated and described. Rather, it is intended that the scope of the invention be determined by the appended claims.

What is claimed is:

1. A blister package comprising:

a base layer; and a blister layer having one or more article receiving blisters formed therein for holding a medicament, said blister layer having one or more tearing blisters formed therein, said tearing blisters extending from one or more outer edges of said blister layer toward one or more of said article receiving blisters, said blister layer being joined to said base layer except in the areas of said article receiving blisters and said tearing blisters, said base layer and said blister layer being joined such that opening the blister package requires tearing through one of said tearing blisters and said one or more article receiving blisters.

2. The blister package of claim 1 wherein said tearing blisters have an elongated form.

3. The blister package of claim 1 wherein said blister layer is formed of a thermoplastic material or cold-form material.

4. The blister package of claim 1 wherein said article receiving blisters and said tearing blisters are thermoformed or cold-formed in said blister layer.

5. The blister package of claim 1 wherein the portions of said base layer and said blister layer that are joined together cannot be readily torn from the outer edges of the blister package, but the portion of the blister layer that forms the tearing blister is thin enough that the tearing blister and the portion of said base layer under the tearing blister can be readily torn from the outer edge of the blister package.

6. The blister package of claim 1 wherein said base layer is comprised of a material and thickness that cannot be readily ruptured by pushing on a medicament in said article receiving blister.

7. The blister package of claim 1 wherein a portion of said base layer under one or more of said tearing blisters is removed to enhance the ease of tearing through said tearing blisters.

8. A blister package comprising:

a base layer; and a blister layer having an article receiving blister formed therein for holding medicaments, said blister layer having one or more tearing blisters formed therein, said blister layer being joined to said base layer except in the areas of said article receiving blister and said tearing blisters, said base layer and said blister layer being joined such that opening the blister package requires tearing through one of said tearing blisters and said article receiving blister, wherein one or more of said tearing blisters extend from one or more outer edges of said blister layer toward said article receiving blister, and the portions of said base layer and said blister layer that are joined together cannot be readily torn from the outer edges of the blister package, but the portion of the blister layer that forms the tearing blister is thin enough that the tearing blister and the portion of said base layer under the tearing blister can be readily torn from the outer edge of the blister package.

9. A medication package having an array of separable blister packages, each of said blister packages comprising:

a base layer; and a blister layer having an article receiving blister formed therein for holding medicaments, said blister layers having one or more tearing blisters formed therein, wherein said tearing blisters extend from one or more outer edges of said blister layer toward said article receiving blister, said blister layer being joined to said base layer except in the areas of said article receiving blister and said tearing blisters, said base layer and said blister layer being joined such that opening the blister package requires tearing through one of said tearing blisters and said article receiving blister.

10. The medication package of claim 9 wherein said array of separable blister packages with said base layer and said blister layer are formed from one integral base layer and one integral blister layer with tear lines in said base layer and said blister layer, said tear lines enabling the separation of said individual blister packages from each other.

11. The medication package of claim 10 wherein said tear lines comprise one or more of the group consisting of perforations, score lines, slits, weakened fracture lines, and tear line tearing blisters.

12. The blister package of claim 9 wherein a portion of said base layer under one or more of said tearing blisters is removed to enhance the ease of tearing through said tearing blisters.

13. A blister package comprising:

a blister layer having one or more article receiving blisters formed therein for holding a medicament; and a base layer having one or more tearing blisters formed therein, wherein said tearing blisters extend from one or more outer edges of said base layer toward the area of said base layer that is at one or more of said article receiving blisters, said blister layer being joined to said base layer except in the areas of said article receiving blisters and said tearing blisters, said base layer and said blister layer being joined such that opening the blister package requires tearing through one of said tearing blisters and said one or more article receiving blisters.

14. The blister package of claim 13 wherein one or more of said tearing blisters extend from one or more comers of said base layer toward the area of said base layer that is at one or more of said article receiving blisters.

15. The blister package of claim 13 wherein the portions of said base layer and said blister layer that are joined together cannot be readily torn from the outer edges of the blister package, but the portion of the base layer that forms the tearing blister is thin enough that the tearing blister and the portion of said blister layer at said tearing blister can be readily torn from the outer edge of the blister package.

16. A blister package comprising:

a base layer having one or more first cavities formed therein and one or more second cavities formed therein; and a blister layer having one or more third cavities formed therein and one or more fourth cavities formed therein, wherein said base layer is joined to said blister layer such that said first cavities and said third cavities form one or more article receiving blisters for holding a medicament and said second cavities and said fourth cavities form one or more tearing blisters, wherein said tearing blisters extend from one or more outer edges of said blister package toward one or more of said article receiving blisters, and said base layer and said blister layer are joined such that opening the blister package requires tearing through one of said tearing blisters and said one or more article receiving blisters.

17. The blister package of claim 16 wherein one or more of said tearing blisters extend from one or more outer edges of said blister package toward one or more of said article receiving blisters.

18. The blister package of claim 16 wherein said base layer is made of essentially the same material as said blister layer.

19. The blister package of claim 1 wherein one or more of said tearing blisters extend from one or more comers of said blister layer toward one or more of said article receiving blisters.

* * * * *